US005210460A

United States Patent [19]

Utsumi et al.

[11] Patent Number: 5,210,460

[45] Date of Patent: May 11, 1993

[54] ELECTRON GUN SUPPORTING MEMBER

[75] Inventors: Ichiro Utsumi; Koichi Furui, both of Kanagawa, Japan

[73] Assignee: Sony Corporation, Tokyo, Japan

[21] Appl. No.: 800,207

[22] Filed: Nov. 29, 1991

[30] Foreign Application Priority Data

Nov. 30, 1990 [JP] Japan ..... 2-126426[U]

[51] Int. Cl.[5] ..... H01J 29/82; H01J 29/94

[52] U.S. Cl. ..... 313/456; 313/417; 313/451; 313/457; 313/481

[58] Field of Search ..... 313/417, 457, 481, 451, 313/456

[56] References Cited

U.S. PATENT DOCUMENTS 2,575,835 11/1951 Pohle ..... 313/451
2,840,739 6/1958 Lesovicz ..... 313/457
4,009,411 2/1977 Puhak ..... 313/417 X

FOREIGN PATENT DOCUMENTS 163340 8/1985 Japan ..... 313/456

*Primary Examiner*—Palmer C. Demeo
*Attorney, Agent, or Firm*—Hill, Steadman & Simpson

[57] ABSTRACT

An electron gun supporting member for securing and supporting an electron gun within a cathode ray tube, such as a Braun tube of a television receiver, is disclosed. The electron gun supporting member is comprised of a shield section, electron gun supporting sections and connecting sections. The function of the electron gun supporting sections is to secure and support the electron gun with respect to the cathode ray tube, while that of the connecting sections is to establish electrical connection between the last electrode of the electron gun and an electrically conductive layer formed on the inner wall of the cathode ray tube. The electron gun supporting sections and the connecting sections are bent obliquely outwards in a direction opposite to the direction of insertion of the electron gun into the cathode ray tube.

2 Claims, 3 Drawing Sheets

ELECTRON GUN SUPPORTING MEMBER

BACKGROUND OF THE INVENTION

1. Field of the Invention

This invention relates to an electron gun supporting member supporting an electron gun enclosed in a cathode ray tube of, for example, a television receiver or a terminal display apparatus.

2. Description of the Prior Art

Referring to FIG. 4, an electron gun 51, enclosed in a cathode ray tube of, for example, a television receiver or a terminal display apparatus, is assembled by having its plural electrodes, that is, a first grid $G_1$, a second grid $G_2$, a third grid $G_3$ and a fourth grid $G_4$, secured at predetermined intervals to a glass supporting rod, not shown, and is supported with respect to a neck part 53*a* of the cathode ray tube 53 by plural spring conductors 52 secured to the last electrode, that is the fourth grid $G_4$.

The spring conductors 52 supporting the electron gun 51 are bent elastically deformable metal conductors mounted on a terminal part of the fourth grid $G_4$ as the last electrode. That is, each spring conductor 54 has its distal end part 52*a* welded to the lateral side of the fourth grid $G_4$ while having its bent part 52*b* kept in pressure contact with an electrically conductive film 54, formed of carbon particles, on the inner wall surface of the cathode ray tube 53. It is under the force of bias exerted by the spring conductors 54 that the electron gun 51 is supported with respect to the cathode ray tube 53.

The spring conductors 52 have two functions, namely the function of supporting the electron gun 51 with respect to the cathode ray tube 53 by being pressed into contact with the electrically conductive film 54 and the function of supplying a high electrical voltage supplied from an anode button 55 to the fourth grid $G_4$ through the electrically conductive film 54. Consequently, not only a large force of bias sufficient to stably support the electron gun 51 against vibrations but also electrical conductivity to achieve electrical conduction, is required of the spring conductors.

In consideration that the spring conductors 52 are required to perform these two functions, the spring conductors 52 need to be provided at an area of the cathode ray tube which is provided with the electrically conductive film 54 and which lies ahead of the foremost part of the fourth grid $G_4$ in the inserting direction of the electron gun for establishing electrical connection thereof with the electrically conductive film 54. For this reason, when the electron gun 51 is inserted into the cathode ray tube 53, the spring conductors exhibiting a larger force of bias has to be slidingly contacted with the electrically conductive film 54 over a longer distance. The result is that the carbon particles of the electrically conductive film 54 are rubbed and scaled off by the spring conductors 52 to lower voltage withstand characteristics or to cause electrical discharge or pollution or a phosphor surface. Although such disadvantage may be reduced by using spring conductors 52 with a weaker force of bias, use of spring conductors with too weak a force of bias leads to reduced resistance against vibrations to detract from the function of the spring conductors in supporting the electron gun 51.

In addition, the operation of welding each of the spring conductors 52 to the fourth grid $G_4$ is laborious and presents problems in production costs due to an increased number of process steps.

SUMMARY OF THE INVENTION

In view of the above described status of the art, it is a principal object of the present invention to provide an electron gun supporting member whereby the electron gun may be supported reliably and electrical connection between the electrically conductive film and the last electrode may be established reliably.

It is another object of the present invention to provide an electron gun supporting member whereby scaling off of the electrically conductive film may be eliminated.

It is a further object of the present invention to provide an electron gun supporting member having a reduced number of components whereby the number of process steps for producing the electron gun supporting member may be reduced to lower its production costs.

According to the present invention, there is provided an electron gun supporting member for supporting an electron gun enclosed in a cathode ray tube in which the function of supporting the electron gun with respect to the cathode ray tube and the function of electrically connecting the last electrode of the electron gun to the electrically conductive layer formed on the inner wall surface of the cathode ray tube are isolated from each other and wherein parts separately taking charge of these functions are provided for extending in the direction opposite to the direction of inserting the electron gun into the cathode ray tube for positively supporting the electron gun and positively electrically connecting the last electrode to the electrically conductive layer as well as preventing generation of debris due to scaling off of the electrically conductive layer.

With the electron gun supporting member according to the present invention, the function of supporting the electron gun with respect to the cathode ray tube is isolated from the function of electrically connecting the last electrode of the electron gun to the electrically conductive layer formed on the inner wall surface of the cathode ray tube. Specifically, the electron gun supporting sections playing the role of supporting the electron gun are adapted for being resiliently biased against the portion of the inner wall of a neck part of the cathode ray tube not provided with the electrically conductive layer for achieving the role of supporting the electron gun, whilst the connecting parts playing the role of establishing electrical connection are adapted for being contacted with the electrically conductive layer for electrically connecting the electrically conductive layer to the last electrode. Since the electron gun supporting sections are used only for supporting the electron gun, the force of bias thereof may be larger to assure more stable support of the electron gun. On the other hand, since the connecting sections are used for establishing electrical connection only, the force of bias thereof may be smaller to assure reliable electrical connection.

In addition, since the electron gun supporting sections and the connecting sections are adapted for being extended in a direction opposite to the direction of inserting the electron gun into the cathode ray tube, there is no risk of the electron gun supporting sections being contacted with the electrically conductive layer provided on the inner wall surface of the cathode ray tube. On the other hand, since the force of bias of the connecting sections adapted for being contacted with the electrically conductive layer is smaller, there is no risk of the electrically conductive layer being scored by friction during insertion of the electron gun into the cathode ray tube.

In this manner, during the time when the electron gun and the electron gun supporting member mounted thereon are being inserted into the cathode ray tube, the risk of the connecting sections coming into strong frictional contact with the electrically conductive layer to cause scaling off of carbon particles may be avoided for preventing voltage withstand properties of the cathode ray tube from being lowered while preventing electrical discharge or contamination of the phosphor surface.

DESCRIPTION OF THE PREFERRED EMBODIMENT

A preferred embodiment of the present invention will be explained hereinbelow.

Figure 1:
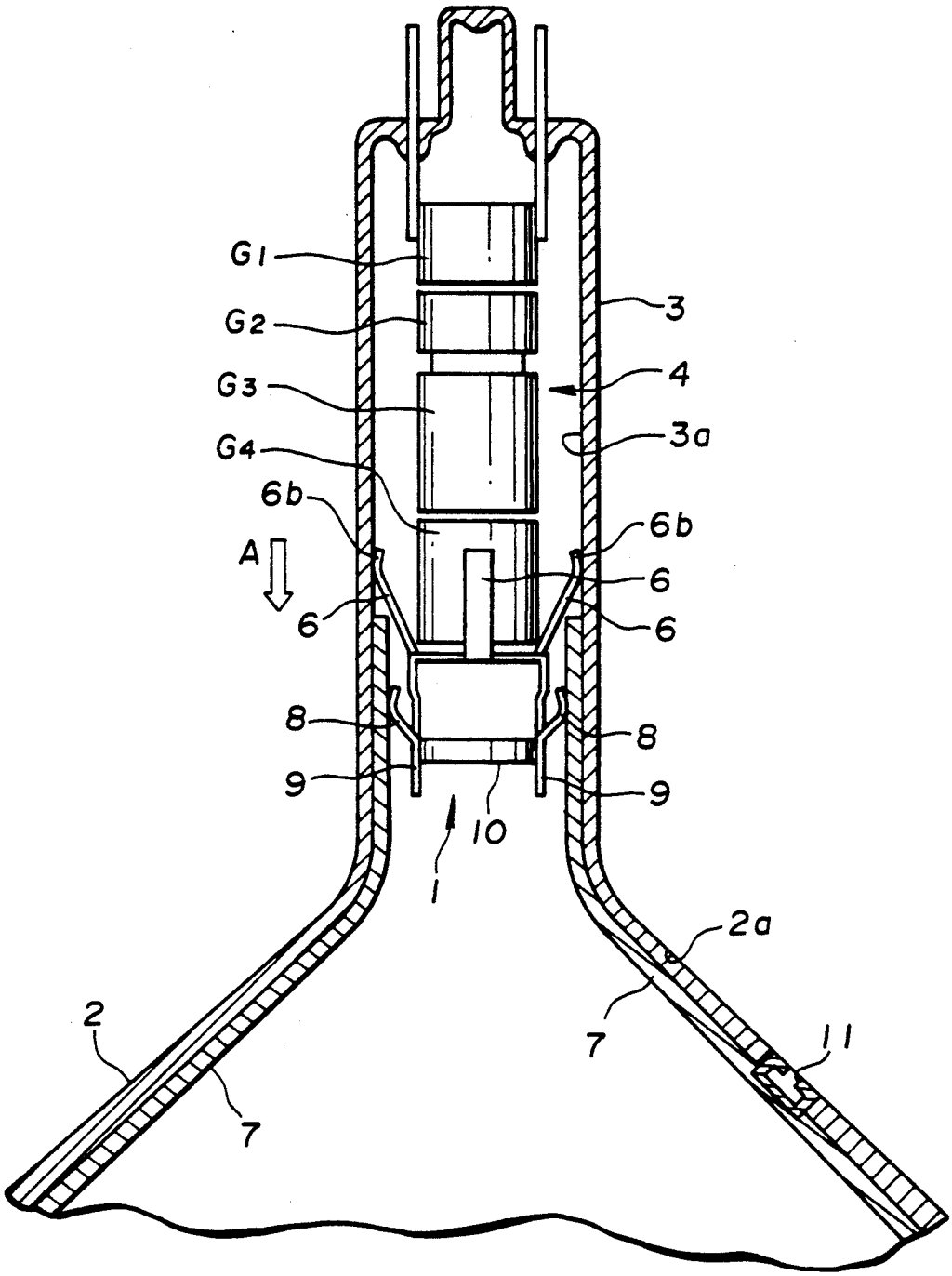
FIG. 1 is a partial cross-sectional view of a cathode ray tube showing an electron gun supporting member of the present invention and an electron gun supported thereby, and showing the state in which the electron gun is supported by the electron gun supporting member with respect to the cathode ray tube.

Referring to FIG. 1, an electron gun supporting member according to the preferred embodiment is mounted on the last electrode of an electron gun 4 enclosed within a neck part 3 of a cathode ray tube 2. Specifically, the electron gun supporting member 1 is mounted on a fourth grid $G_4$ as the last electrode of the electron gun 4 provided with a group of electrodes comprised of a first grid $G_1$, a second grid $G_2$ and a third grid $G_3$, beside the fourth grid $G_4$. The grids $G_1$ to $G_4$ are sequentially connected and secured to an insulating supporting rod, not shown, at predetermined intervals.

Figure 2:
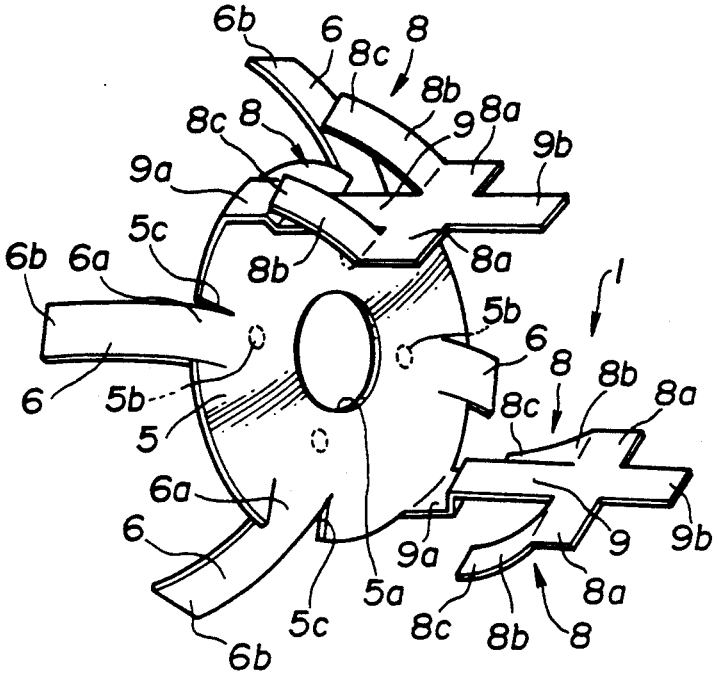
FIG. 2 is an enlarged perspective view of the electron gun supporting member of the present invention.
Figure 3:
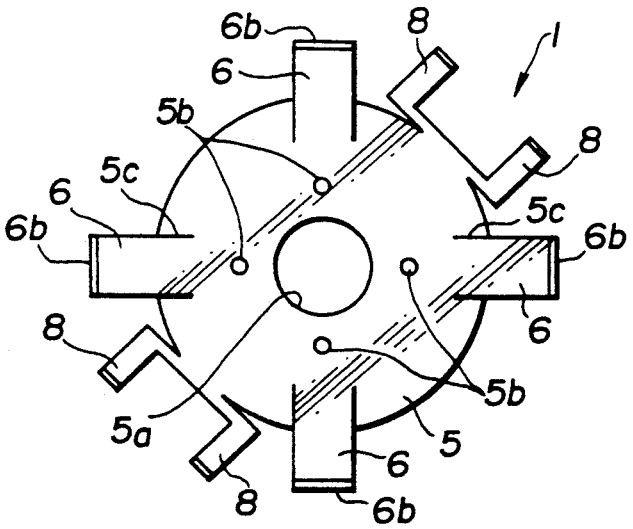
FIG. 3 is an enlarged bottom plan view thereof.
Figure 4:
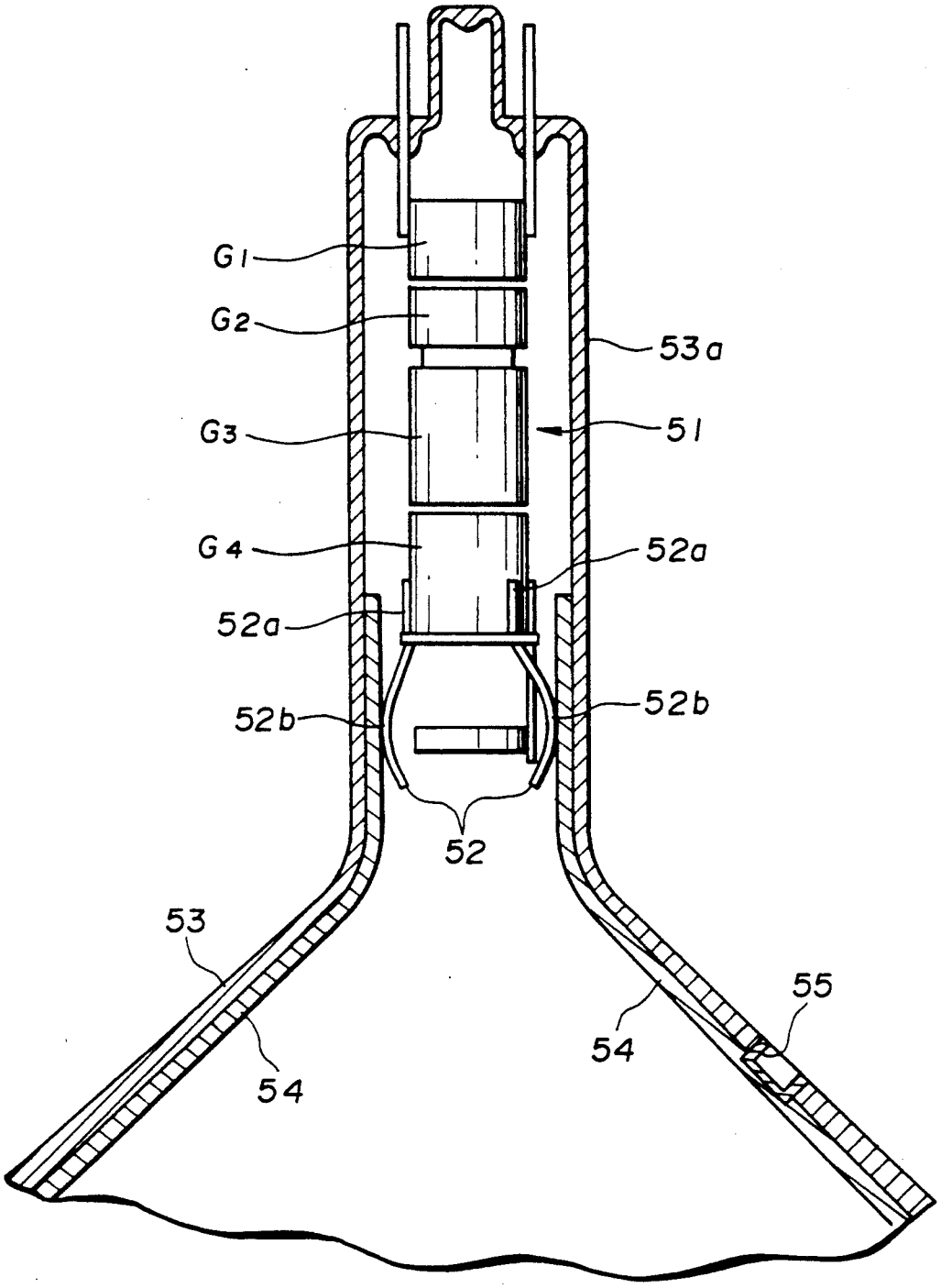
FIG. 4 is a partial cross-sectional view of a cathode ray tube showing a conventional electron gun supporting member and an electron gun supported thereby, and showing the state in which the electron gun is supported by the electron gun supporting member with respect to the cathode ray tube.

Referring to FIGS. 2 and 3, the electron gun supporting member 1 is formed of a one-piece sheet of an electrically conductive spring metal punched and bent to a predetermined shape. It is comprised of a shield section 5, mounted on the fourth grid $G_4$ of the electron gun 4, a plurality of electron gun supporting sections 6 provided on the shield section 5 and adapted for being resiliently biased against an inner wall 3*a* of the neck part 3 of the cathode ray tube 2 for supporting the electron gun 4 with respect to the cathode ray tube 2, and a plurality of connecting sections 8 provided on the shield section 5 and contacted with an electrically conductive layer 7 formed on an inner wall surface 2*a* of the cathode ray tube 2 for establishing electrical connection between the electrically conductive layer 7 and the fourth grid $G_4$.

The shield section 5 is formed as a disc of a size large enough to be mounted on the distal part of the fourth grid $G_4$, and has a central circular aperture 5*a* for transmitting an electron beam from a cathode, not shown, provided in the first grid $G_4$. A plurality of substantially hemispherical projections 5*b* for welding the shield section 5 to the fourth grid $G_4$ are formed around the rim of the beam-transmitting aperture 5*a* of the shield section 5. Four such projections 5*b* are provided on the surface of the shield section 5 facing the distal part of the fourth grid $G_4$ for reliably welding the shield section 5 to the fourth grid $G_4$.

The electron gun supporting sections 6 supporting the electron gun 4 with respect to the cathode ray tube 2 are provided at equiangular distances on the outer rim of the shield section 5. With the present embodiment, four electron gun supporting sections 6 are provided for reliably supporting the electron gun 4. These electron gun supporting sections 6 are flat rectangular tongues which are integrally punched with the shield section 5 and which are bent for extending in a direction opposite to the inserting direction of the electron gun 4 into the cathode ray tube 2 shown by an arrow A in FIG. 1. Specifically, each supporting section 6 is bent for extending obliquely outwards in the direction opposite to the direction shown by arrow A in FIG. 1, beginning from a proximal part 6*a* defined by slits 5*c* which extend some distance from the outer rim of the shield section 5 towards the beam-transmitting aperture 5*a*. Each supporting section 6 has its distal part 6*b* bent arcuately for assuring optimum pressure contact thereof against the inner wall of the cathode ray tube 2. Since the electron gun supporting sections 6 are used solely for supporting the electron gun 4, the distal parts 6*b* are adapted to be resiliently pressed against the inner wall 3*a* of the neck part 3 which is not provided with the electrically conductive layer 7. Thus the force of bias exerted by the electron gun supporting sections 6 is selected to be large enough to support the electron gun 4 positively. It is noted that the electron gun supporting sections 6 are formed for extending in a direction opposite to the inserting direction of the electron gun 4 into the cathode ray tube 2 and hence are not brought into contact with the electrically conductive layer 7 formed on the inner wall 2*a* of the cathode ray tube 2.

The connecting parts 8, adapted for being contacted with the electrically conductive layer 7 formed on the inner wall surface 2*a* of the cathode ray tube 2 for electrically connecting the electrically conductive layer 7 with the fourth grid $G_4$, are formed with a pair of getter supporting lugs 9 formed at diametrally opposite portions of the shield section 5 between adjacent ones of the electron gun supporting sections 5. It is noted that the electrically conductive layer 7 is electrically connected to an anode button 11 provided on the cathode ray tube 2 so that a high electrical voltage supplied from the anode button 11 is supplied to the electrically conductive layer 7.

Each getter supporting lug 9 is a rectangular tongue punched integrally with the shield section 5 and bent in a direction opposite to the extending direction of the electron gun supporting sections 6, that is, it is bent in the inserting direction of the electron gun 4 into the cathode ray tube 2 shown by the arrow A in FIG. 1 substantially at right angles with respect to the welding surface of the shield section 5 to the fourth grid $G_4$. Meanwhile, the getter supporting lugs 9 are bent slightly towards the beam-transmitting aperture 5*a* in the vicinity of a proximal part 9*a* contiguous to the shield section 5 so that distal parts 9*b* are drawn slightly closer towards each other. A circular getter 10 for maintaining vacuum in the cathode ray tube 2 as later described is supported between distal ends of the getter supporting lugs 9 thus drawn closer towards each other.

The aforementioned connecting parts 8 are formed at those positions of the getter supporting lugs 9 different from the positions thereof provided with the getter 10. Each connecting part 8 is a flat substantially U-shaped tongue punched integrally with the shield section 5 and the getter supporting lugs 9. Specifically, one connecting part 8 is formed on each longitudinal side edge of each getter supporting section 9 and has a web part 8*a* of the letter U extending normal to the longitudinal direction of the getter supporting lug 9. Each connecting part 8 has an extension 8*b* extending normal to the web part 8*a* in a direction opposite to the inserting direction of the electron gun 4 into the cathode ray tube 2 as shown by arrow A in FIG. 1. Similarly to the electron gun supporting sections 6, these extensions 8*b* are bent for extending obliquely outwards from the proximal web part 8*a* so that the distal parts 8*c* will be brought into contact with the electrically conductive layer 7. Meanwhile, these extensions 8*b* are also bent in profile so as not to score the electrically conductive layer 7 formed on the inner wall 2*a* of the cathode ray tube 2.

It is the sole function of the connecting parts 8 to establish electrical connection between the electrically conductive layer 7 on the inner wall of the cathode ray tube 2 and the fourth grid $G_4$. Therefore, the force of bias of these connecting parts 8 only large enough to assure current conduction through the conductive layer 7 suffices and is desirably about one half of the force of bias of the electron gun supporting sections 6. Specifically, the force of bias to be exerted by the connecting parts 8 is so weak for the connecting parts 8 not to score the electrically conductive layer 7 when the electron gun 4 is inserted into the inside of the cathode ray tube 2 so that the connecting parts 8 are brought into contact with the electrically conductive layer 7. Meanwhile, the getter 10 is held between the sides of the letter U of the connecting parts 8 under the resiliency of the getter supporting lugs 9. Thus the connecting parts 8 provided in the vicinity of the getter 10 may be supported by the getter even under minor vibrations for assuring positive contact thereof with the electrically conductive layer 7.

Meanwhile, the electron gun 4 carrying thereon the above described electron gun supporting member 1 is introduced into the inside of the cathode ray tube 2 with the electron gun supporting member 1 foremost so as to be supported with respect to the cathode ray tube 2. During insertion of the electron gun 4 into the cathode ray tube 2, the connecting parts 8 are kept in contact with the electrically conductive layer 7. However, since the force of bias of the connecting parts 8 is so small as not to rub against and scrape off the electrically conductive layer 7. In addition, since the connecting parts 8 are extended in the direction opposite to the inserting direction of the electron gun 4 into the cathode ray tube 2, the operation of introducing the electron gun 4 may be facilitated, while the distance over which the connecting parts 8 are contacted with the electrically conductive layer 7 is reduced to suppress scraping off of the carbon particles from the electrically conductive layer 7. In this manner, scraping off of carbon particles from the electrically conductive layer 7 which would lower voltage withstand properties or produce electrical discharge or contamination of the phosphor surface may be eliminated positively. On the other hand, since the electron gun 4 is biased by the electron gun supporting sections 6 against the inner wall 3*a* of the neck part 3 not provided with the electrically conductive layer 7 with a large force of bias, the electron gun 4 may be supported reliably with respect to the cathode ray tube 2 for improving reliability against vibrations. Meanwhile, since the electron gun supporting sections 6, connecting parts 8 and the getter supporting sections 9 are formed integrally from a single metal sheet by corresponding punching and bending operations, the mounting operation on the fourth grid $G_4$ may be facilitated while production costs may be reduced.

What is claimed is:

1. A member for supporting an electron gun in the neck of a cathode ray tube comprising, said member formed with a disc-shaped shield section formed with a central opening through which an electron beam that travels in a first direction can pass and mounted on a grid of said electron gun, a plurality of rectangular supporting tongues integrally formed with said disc-shaped shield section and extending obliquely outward in a direction opposite to said first direction and having distal parts arcuately bent so as to contact the inner surface of said neck at a location where there is no electrically conductive layer on said neck so as to mechanically support said electron gun, a plurality of connecting parts integrally formed with said disc-shaped shield section at locations between said plurality of rectangular supporting tongues and each having first portions which extend in the first direction from said disc-shaped shield section and second portions which extend from said first portions in a direction opposite to said first direction and having ends which engage an electrical conductive layer formed on said neck so as to make an electrical connection therewith.

2. A member for supporting an electron gun in the neck of a cathode ray tube according to claim 1 including, a pair of getter supporting lugs integrally formed with said disc-shaped shield section and extending in said first direction therefrom so as to support a getter.

* * * * *